US007301282B2

(12) United States Patent
Niimi

(10) Patent No.: US 7,301,282 B2
(45) Date of Patent: Nov. 27, 2007

(54) HIGH PRESSURE MERCURY LAMPS AND SEALING MEMBERS THEREFOR

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 411 days.

(21) Appl. No.: 10/437,382

(22) Filed: May 14, 2003

(65) Prior Publication Data

US 2003/0222581 A1 Dec. 4, 2003

(30) Foreign Application Priority Data

May 29, 2002 (JP) ..... 2002-155546

(51) Int. Cl.
*H01J 17/18* (2006.01)

(52) U.S. Cl. ..... 313/625; 313/623; 313/571; 313/634

(58) Field of Classification Search ..... 313/632, 313/634, 623–625, 573, 493, 571; 445/22, 445/26, 27; 428/4, 34; 174/17 R, 17.05, 174/17.07, 17.08

See application file for complete search history.

(56) References Cited

U.S. PATENT DOCUMENTS 3,619,682 A * 11/1971 Lo et al. ..... 313/22
4,155,757 A 5/1979 Hing
4,412,963 A * 11/1983 Hing ..... 156/89.12
4,676,994 A * 6/1987 Demaray ..... 427/566
4,749,902 A * 6/1988 Weiss ..... 313/332
4,906,895 A * 3/1990 Pabst et al. ..... 313/632
5,471,110 A * 11/1995 van der Leeuw et al. .... 313/25
5,510,675 A * 4/1996 Bunk et al. ..... 313/631
5,528,101 A * 6/1996 Gosslar et al. ..... 313/493
5,532,552 A 7/1996 Heider et al.
5,810,635 A * 9/1998 Heider et al. ..... 445/26
6,274,983 B1 * 8/2001 Ooyama et al. ..... 313/632
2002/0180357 A1 12/2002 Matsuno et al.

FOREIGN PATENT DOCUMENTS

| | | |
|---|---|---|
| GB | 1571084 | 7/1980 |
| JP | A 55-117859 | 9/1980 |
| JP | B2 60-35422 | 8/1985 |
| JP | A 08-138555 | 5/1996 |
| JP | A 2000-058001 | 2/2000 |
| JP | A 2000-67815 | 3/2000 |
| JP | A 2002-373621 | 12/2002 |

* cited by examiner

*Primary Examiner*—Ashok Patel
(74) *Attorney, Agent, or Firm*—Oliff & Berridge, PLC

(57) ABSTRACT

An object of the invention is to reduce the adverse effects due to a difference of thermal expansion between a conductive sealing member and a light-emitting vessel and to provide a reliable high pressure mercury lamp, even when the lamp is operated at a high pressure. The lamp has a light-emitting vessel 16 of quartz and having end portions, an electrode member 10 contained in the vessel 16, and a conductive sealing member 7A. The sealing member 7A is fixed in the end portion and connected to the electrode member 10. The conductive member is composed of a sintered body made from silica granules each having a coating of a metal or a metal compound. The sintered body has a conductive network structure made of the metal and having a content of the metal of not higher than 20 volume percent.

8 Claims, 8 Drawing Sheets

(a)

(b)

(c)

(d)

(a)

(b)

(a)

(b)

(a)

(b)

(a)

(b)

HIGH PRESSURE MERCURY LAMPS AND SEALING MEMBERS THEREFOR

This application claims the benefits of a Japanese Patent Application P2002-155546 filed on May 29, 2002, the entirety of which is incorporated by reference.

BACKGROUND OF THE INVENTION

1. Field of the Invention

The present invention relates to a high pressure mercury lamp and a sealing member for the lamp.

2. Related Art Statement

A high pressure mercury lamp has been used in an OHP (overhead projector), a liquid crystal projector and a headlamp for a vehicle. Such lamp has a light-emitting vessel made of quartz and mercury vapor sealed in the vessel at a high pressure. The light-emitting vessel is made of quartz and thus transparent, so that discharge arc in the vessel emitting light functions as a point light source.

Japanese patent publication 55-117, 859 discloses a high pressure discharge lamp having a metal foil fixed in the end portion of the light-emitting vessel of quartz so that the end portion is pinch sealed. The metal foil may be composed of a molybdenum foil coated with the other metal such as tantalum, niobium, chromium, yttrium or the like. According to the sealing process, after the molybdenum foil is provided inside of the end portion of the vessel, the end portion is heated to soften it. After the end portion is softened, the molybdenum foil is pressed so that the end portion is sealed with a pressure applied from the end portion onto the foil.

SUMMARY OF THE INVENTION

The molybdenum foil has a low stiffness so as to relax a stress from the end portion onto the foil. When the lamp is operated at a high pressure, however, the concentration of stress due to a difference of thermal expansions of the molybdenum foil and light-emitting vessel becomes significant. Such concentration of stress may be a cause of the reduction of reliability of the mercury lamp.

Further, in a high pressure mercury lamp, it is necessary to reduce the arc distance at a value not larger than 2 mm for utilizing the discharge arc as a point light source. It is thus necessary to control a distance between a pair of electrodes at a specified value and to adjust the longitudinal directions of the electrodes substantially parallel with each other, in the light-emitting vessel. In the lamp, however, the molybdenum foil is provided in the end portion of the vessel, and a pressure is applied to the end portion so that the end portion is deformed and sealed with the foil. The molybdenum foil may be inclined or the position of the foil may be changed, in the sealing process, due to the distribution of the pressure. Consequently, the distance between a pair of the electrodes is deviated from a designed value or the longitudinal directions of the electrodes might be not parallel with each other. In this case, the shape of the discharge arc may be changed from a designed shape to adversely affect the light emission property.

An object of the present invention is, in a high pressure mercury lamp having a light-emitting vessel made of quartz, to reduce the adverse effects due to a difference of thermal expansion between a conductive sealing member and the vessel and to provide a reliable lamp, even when the lamp is operated at a high pressure.

The present invention provides a high pressure mercury lamp having a light-emitting vessel made of quartz and having end portions, an electrode member contained in the vessel, and a conductive sealing member. The conductive member is fixed in the end portion and electrically connected with the electrode members. The sealing member is composed of a sintering body made from silica granules each having a coating of a metal or a compound of a metal. The sintered body has a conductive network structure made of the metal and having a content of the metal of not higher than 20 volume percent.

Further, the invention provides a conductive sealing member for a high pressure mercury lamp having a light-emitting vessel made of quartz and having end portions. The sealing member is to be fixed in the end portion. The conductive member is composed of a sintering body made from silica granules each having a coating of a metal or a compound of a metal. The sintered body has a conductive network structure made of the metal and having a content of the metal of not higher than 20 volume percent.

According to the high pressure discharge lamp of the present invention, a particular cermet is used as a sealing member for the end portion of the light-emitting vessel made of quartz. The cermet is composed of a sintered body of silica granules each having a coating of a metal or a metal compound. In the sintered body, the metal constitutes a conductive network structure and the content of the metal is made not higher than 20 volume percent in the sintered body. It is thus possible to considerably reduce a difference of thermal expansion coefficients of the vessel and sealing member and to prevent the reliability of the lamp, even when an inner pressure in the vessel is increased.

These and other objects, features and advantages of the invention will be appreciated upon reading the following description of the invention when taken in conjunction with the attached drawings, with the understanding that some modifications, variations and changes of the same could be made by the skilled person in the art.

BRIEF DESCRIPTION OF THE DRAWINGS

FIG. 1(*b*) schematically shows microstructure of a sintered body 4 constituting a conductive sealing member.

FIG. 1(*c*) shows a conductive sealing member 7A substantially cylindrical shaped.

FIG. 1(*d*) is a plan view showing an end face 7*a* of the conductive sealing member 7A.

FIG. 2(*b*) is a front view showing a conductive member 7C.

FIG. 3(*b*) is a cross sectional view showing a conductive member 7D equipped with an electric supply means 8 and electrode member 10.

FIG. 4(*b*) is a cross sectional view showing the conductive sealing member 7A fixed in the end portion 19 of the vessel 16 after the end portion is deformed with a pressure.

FIG. 5(*b*) shows relative position of the conductive sealing member 7A and the end portion 19 of FIG. 4(*b*), after the end portion is deformed to fix the sealing member therein.

PREFERRED EMBODIMENTS OF THE INVENTION

The present invention will be further described in detail

The light-emitting vessel is composed of quartz, which is a glass mainly consisting of $SiO_2$ (quartz) phase. The glass may contain various crystalline phases other than quartz phase.

Figure 1:
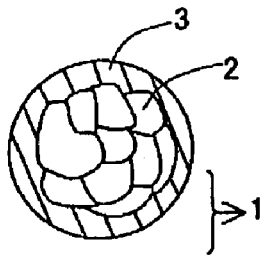
FIG. 1(*a*) is a cross sectional view schematically showing a silica granule 1 with a coating of a metal or metal compound.
Figure 1:
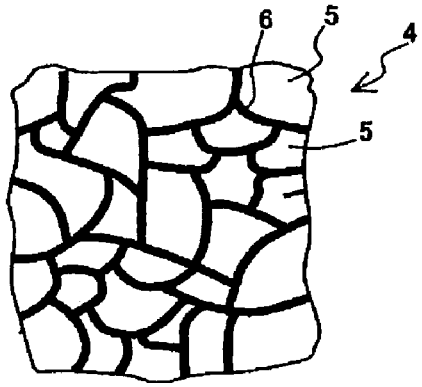
Figure 1:
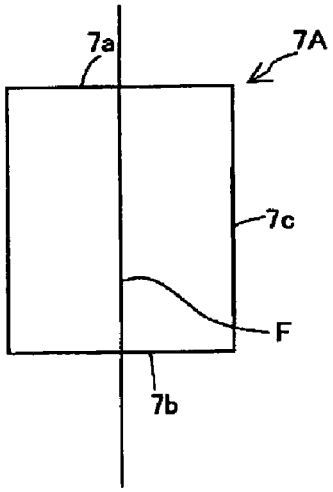
Figure 1:
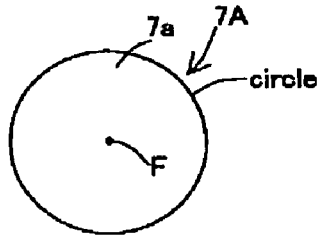

The conductive sealing member is composed of a sintered body of silica granules each having a coating of a metal or metal compound. That is, as schematically shown in FIG. 1(*a*), each of the silica granules 1 (starting material) has a silica particle 2 and a coating 3 of a metal or a metal compound coating the particle 2. The silica granules 1 are sintered to produce a sintered body 4 as shown in FIG. 1(*b*). That is, the silica granules 1 are molten and joined with each other during the sintering process to form a bone structure, and the metal coatings on the granules 1 are connected with each other at the same time. A sintered body 4 is thus produced having particles 5 mainly consisting of silica and intergranular phases 6 connecting the particles 5. The intergranular phase 6 is mainly consisting of the metal constituting the coating 3. Alternatively, the intergranular phase is made of a metal generated from the metal compound constituting the coating 3 during the sintering process. The intergranular phase 6 constitutes a conductive network structure over the whole of the cermet.

The content of a metal in the sintered body 4 is not higher than 20 weight percent. In the sintered body, the conductive network structure 6 is provided over the whole of the cermet so that a relatively low resistance may be obtained even when the metal content is low.

The above structure is described in Japanese patent publication 60-35422 (GB 9359/76). Japanese patent publication 60-35422 disclosed that this kind of sintered body is used as a sealing member for a ceramic discharge vessel of a high pressure discharge lamp. The publication discloses that the discharge vessel and sealing member are sealed with a glass frit. It is not related to a high pressure mercury lamp. Further, in the publication, the end portion of the light-emitting vessel is not deformed by a pressure to fix the sealing member therein. The invention of the publication is not for solving the problems accompanying with the technique. The ceramic discharge vessel is not deformable with applying a pressure and the sealing member can not be fixed in the vessel with the deformation of the vessel.

The metal constituting the metal coating of the silica granules is not particularly limited, and includes the following metals and alloys thereof.

W, Mo, W—Mo, W—Ni, Mo—Ni

Further, the coating of the silica granules may be made of a metal compound. The metal compound is sintered under conditions to generate a metal after the sintering process. In a preferred embodiment, the metal compound is a metal oxide. In this case, the metal oxide is finally subjected to reduction sintering process so that the metal oxide is converted to a metal. The metal oxide includes the following oxides and the mixture thereof.

$WO_3$, $MoO_3$, $Wo_3$—$MoO_3$, $WO_3$—NiO, $MoO_3$—NiO, $WO_3$—$MoO_3$—NiO

Further, the metal compound may not be a metal oxide. In this case, however, it is necessary to convert the metal compound into a metal oxide, which is finally subjected to reduction sintering process to convert the oxide into a metal. Such metal compound includes inorganic salts such as a nitride or sulfate of the metal, or organic salts such as oxalate.

The silica granules may be coated by any methods. Preferably, slurry of powder of a metal or metal compound is coated onto silica granules.

The following advantages are obtained by applying the coating with a metal oxide or metal compound. That is, the silica granules have a density as low as about 2.2 g/cc. A metal has a higher density. For example, tungsten has a density of 19.3 g/cc When silica granules and tungsten powder is mixed, it is thus difficult to mix them and coat the metal on the granules uniformly due a difference of densities. If the metal powder and silica granules are not uniformly mixed, a content of silica granules without the metal coating and with a small amount of metal coating is increased. It is thus difficult to maintain the resistance of the conductive sealing member at a specific value. On the contrary, the density of the metal oxide powder is generally lower than that of the metal powder. For example, tungsten oxide has a density of about 7.2 g/cc, which is nearer to that of silica. It is thus possible to mix the silica granules and metal oxide powder uniformly.

In a particularly preferred embodiment, two or more kinds of metals are mixed in the conductive sealing member. The followings are preferred combinations of metals.

W—Ni, Mo—Ni, W—Mo—Ni

In a particularly preferred embodiment, powders of an oxide of a first metal and a compound of a second metal are mixed. In the embodiment, the metal compound may be dissolved into a solvent to obtain solution, which is then mixed with the oxide of the first metal. In this case, the compound of the second metal may be mixed into the oxide of the first metal uniformly, even when the content of the compound of the second metal is very small.

The maximum temperature in the sintering process of the silica granules may be selected depending on the material and not particularly limited. Further, the sintering process may be performed under air or an inert gas, or reducing atmosphere when the metal oxide is to be reduced during the sintering process. The reducing atmosphere includes $N_2$+$H_2$ and Ar+$H_2$.

According to the present invention, the conductive sealing member is inserted into the opening in the end portion of the light-emitting vessel made of quartz. The end portion is heated and mechanically pressed to deform the end portion toward the sealing member so that the sealing member is fixed in the opening of the end portion. The process is referred to as fixing by deformation with pressure. When a ceramic light-emitting vessel of alumina or the like is used, it is difficult to deform the vessel during the heating process, so that the above fixing method by deformation can not be used. It is thus generally used to seal the vessel with a glass frit or the like. According to the present invention, a difference is small between the thermal expansion coefficients of the sealing member and quartz during the thermal cycles after the fixing process. It is thus possible to maintain excellent reliability even when the inner pressure of the vessel is high.

In a preferred embodiment, the thermal coefficient of the silica granules constituting the conductive sealing member is $0.5\times10^{-6\circ}$ C.$^{-1}$~$1.0\times10^{-6\circ}$ C.$^{-1}$. Further, the content of the metal in the sintered body may preferably be not higher than 20 volume percent, and more preferably be not higher than 12 volume percent, for reducing the difference of the thermal coefficients of the sintered body and silica.

Further, it is needed that the conductive sealing member has a resistance suitable for supplying a rated power required for arc discharge to an electrode member. The content of the metal may preferably be not lower than 5 volume percent and more preferably be not lower than 8 volume percent, for reducing the resistance of the sintered body.

The following substances may be contained in the inner space of the light-emitting vessel of the high pressure mercury lamp other than mercury.

A metal halide, such as NaI, $DyI_3$

An inert gas such as argon, xenon, helium

The material for the discharge electrode and supporting member for electrode is not limited. The material may preferably be a metal selected from the group consisting of tungsten, molybdenum, niobium, rhenium and tantalum, or the alloy of two or more metals selected from the group consisting of tungsten, molybdenum, niobium, rhenium and tantalum. Particularly, tungsten, molybdenum, or the alloy of tungsten and molybdenum is preferred. Further, a composite material of a ceramics and the above metal or alloy is preferred.

The inner pressure of the light-emitting vessel may preferably be not lower than 100 atm, and more preferably be not lower than 150 atm, for further improving the luminance of the light-emitting vessel.

In a preferred embodiment, the shape of the conductive sealing member is a body formed by rotating a figure around the central axis of the light-emitting vessel. This embodiment is effective for preventing the change of position of the sealing member during the fixing process and thus to further reduce the change of shape or pattern of the discharge arc. Further in this case, the conductive sealing member may be fixed in the end portion by isotropic fixing process by deformation with a pressure, so that the change of position of the sealing member may be further reduced during the fixing process.

The body of rotation means a three-dimensional geometrical shape obtained by rotating any planar figure around the central axis. The shape includes, but not limited to, a cylinder. The shape includes a tube, ellipsoid of revolution, cone and truncated cone.

Figure 2:
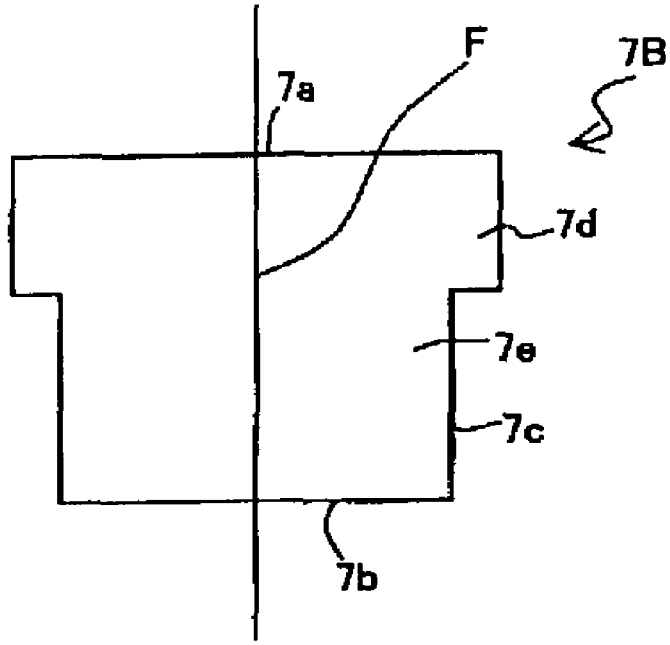
FIG. 2(*a*) is a front view showing a conductive member 7B.
Figure 2:
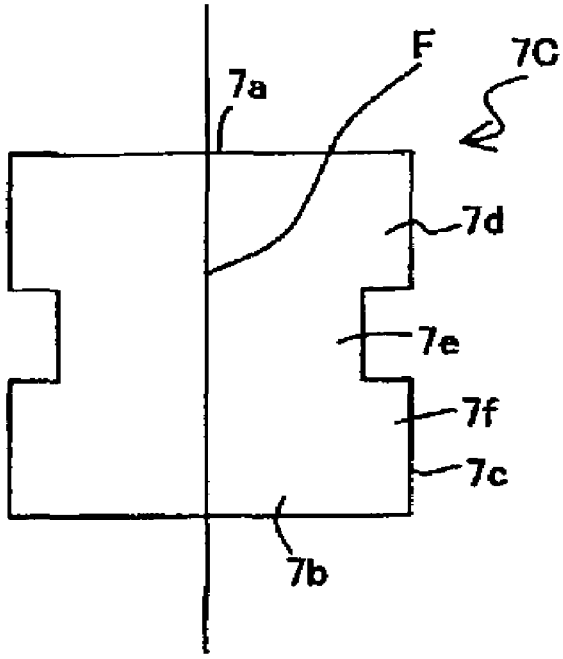

For example, a conductive sealing member 7A has a shape of a cylinder as shown in FIGS. 1(*c*) and 1(*d*). 7*c* represents a side wall surface and 7*a* and 7*b* represent end faces. Further, a conductive sealing member 7B shown in FIG. 2(*a*) has cylindrical bodies 7*d* and 7*e*. The cylindrical body 7*d* is obtained by rotating a rectangle having a larger width and the cylindrical body 7*e* is obtained by rotating a rectangle having a smaller width. A conductive sealing member 7C shown in FIG. 2(*b*) has cylindrical bodies 7*d* and 7*f* and a cylindrical body 7*e*. The cylindrical bodies 7*d* and 7*f* are obtained by rotating rectangles each having a larger width and the cylindrical body 7*e* is obtained by rotating a rectangle having a smaller width. The cylindrical body 7*e* is composed of a pair of cylindrical bodies 7*d* and 7*f*.

Figure 3:
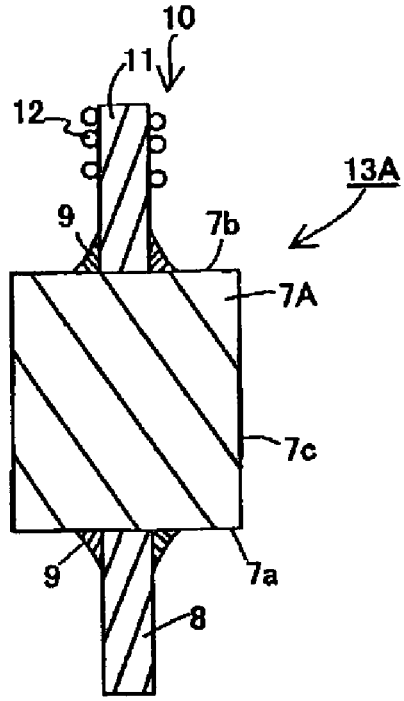
FIG. 3(*a*) is a cross sectional view showing a conductive member 7A equipped with an electric supply means 8 and electrode member 10.
Figure 3:
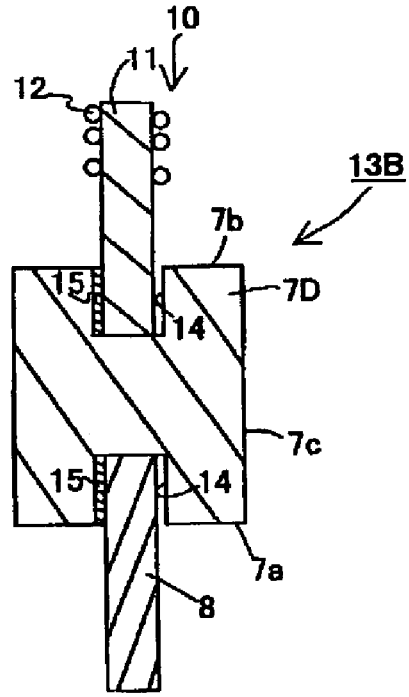

FIG. 3(*a*) is a cross sectional view schematically showing a discharge member 13A having the conductive sealing member 7A. In FIG. 3(*a*), the tip of a power supply member 8 is soldered to the outer end face 7*a* of the cylindrical sealing member 7A with a soldering agent 9. The soldering agent may preferably have a composition of Ni, W—Ni Mo—Ni, W—Mo—Ni, Ru—Mo, or Ru—Mo—B. The electrode member 10 has an electrode 11 soldered to the inner wall face 7*b* of the conductive sealing member 7A with a soldering agent 9. A coil 12 is wound to the tip of the electrode 11 to constitute the electrode. Although the coil 12 is provided in the tip of the electrode 11 in the present example, the coil 12 may be omitted.

Figure 4:
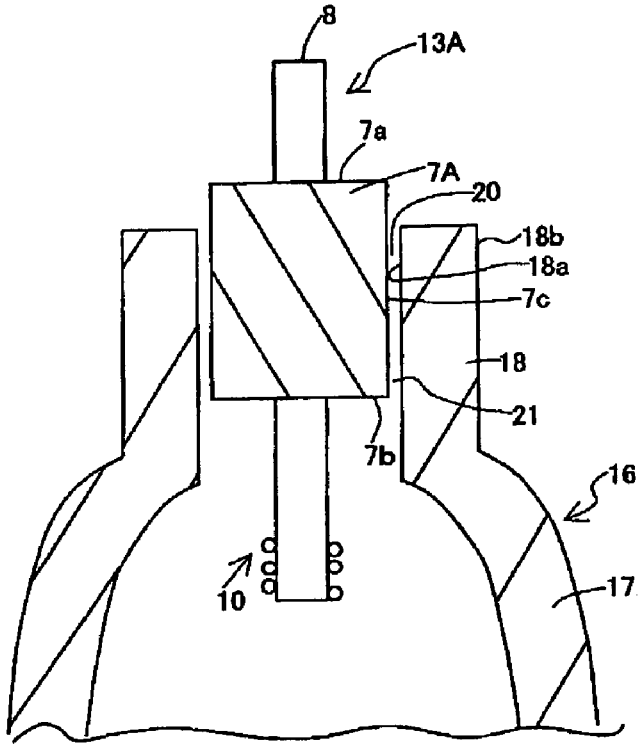
FIG. 4(*a*) is a cross sectional view showing a conductive member 7A inserted in an end portion 18 of a light emitting vessel 16 before the end portion is deformed with a pressure.
Figure 4:
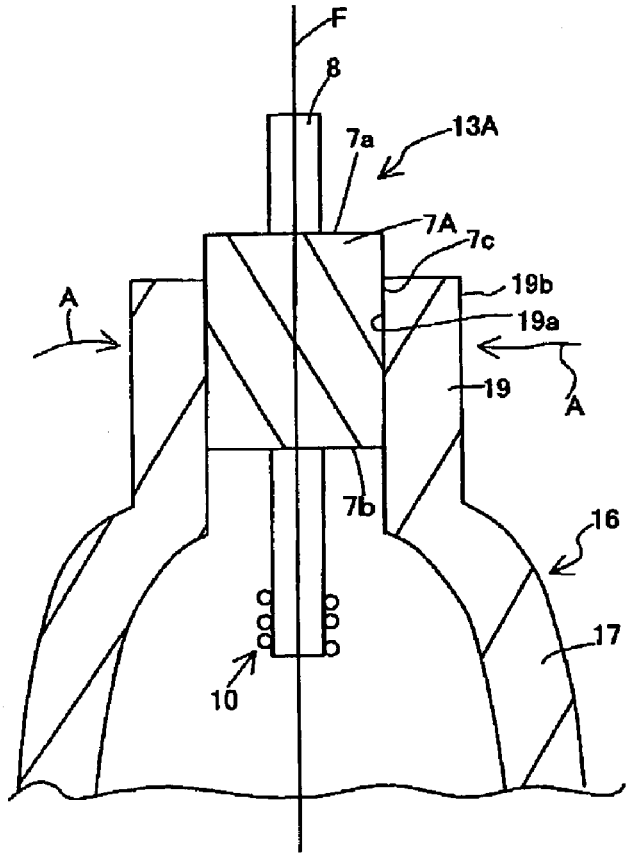

FIG. 4(*a*) is a cross sectional view schematically showing the conductive sealing member 7A inserted into the end portion of the light-emitting vessel. The vessel 16 of the present example has a main body 17 and end portion 18. The end portion 18 has an inner opening 20 formed therein, into which the sealing member 7A is inserted. The electrode member 10 is thus contained in the inner space of the vessel. At this stage, a clearance 21 is formed between the inner wall surface 7*c* of the sealing member 7A and the inner wall surface 18*a* of the end portion 18.

Figure 5:
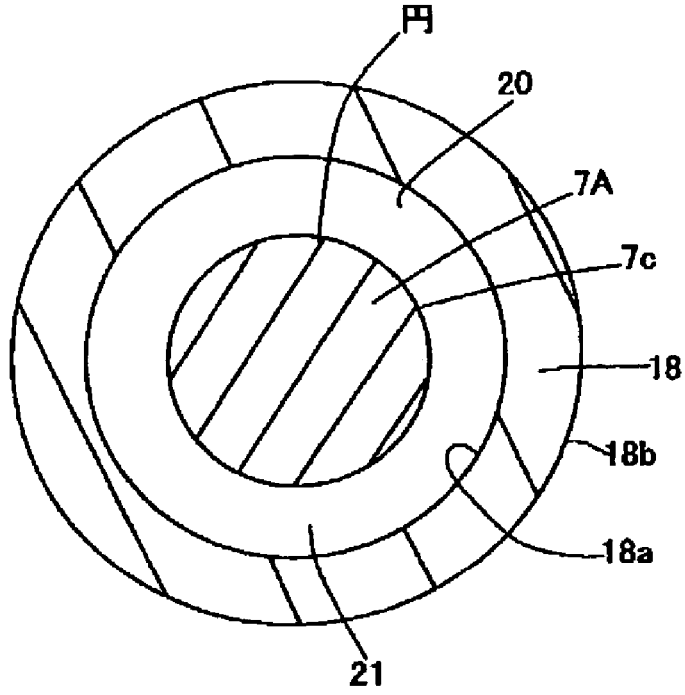
FIG. 5(*a*) shows relative position of the conductive sealing member 7A and light-emitting vessel 18 of FIG. 4(*a*), before the end portion is deformed.
Figure 5:
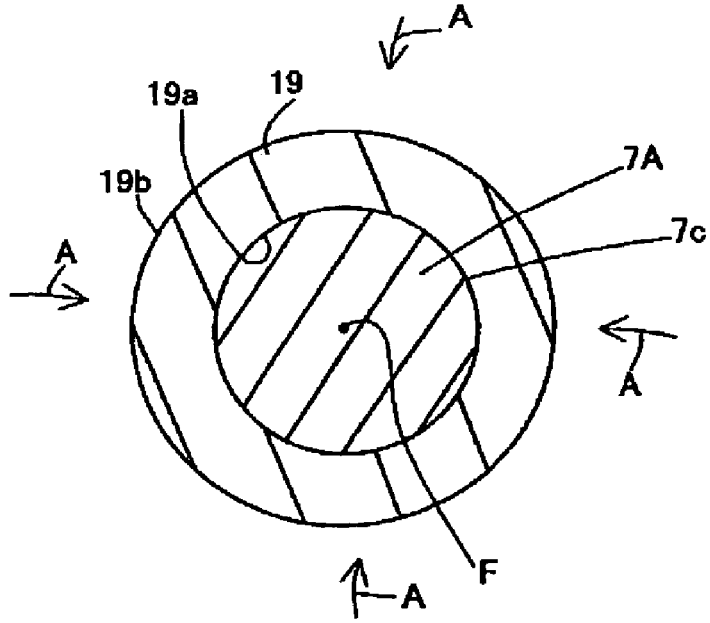

The end portion 18 is then heated to soften it. A pressure is applied to the end portion 18 as shown in FIGS. 4(*b*) and 6(*b*). In the present example, a pressure is applied onto the whole of the outer wall surface 18*b* of the end portion 18 in radial direction with respect to the central axis "F" of the vessel. The end portion 18 is thus pressurized toward the side wall surface 7*c* of the sealing member 7A. Such method of applying a pressure is referred to as isotropic pressurizing. The end portion 18 is deformed as shown in FIG. 5(*b*), so that the inner wall surface 19*a* of the end portion 19 is adhered to the whole of the side wall surface 7*c* of the sealing member 7A with a pressure applied therebetween. 19*b* represents the outer wall surface of the end portion 19. At this stage, a pressure is applied from the end portion onto the sealing member over the whole of the side wall surface 7*c* with respect to the central axis "F" of the vessel.

Figure 6:
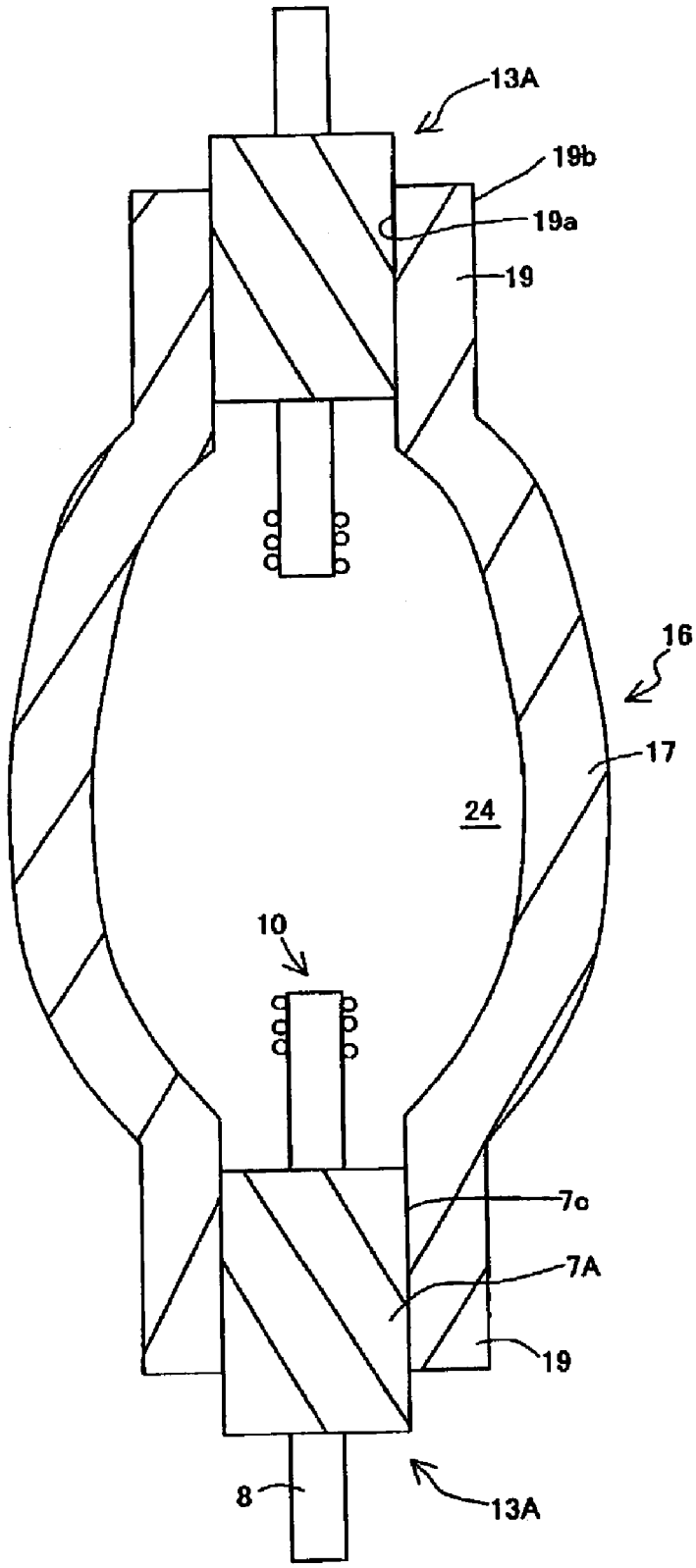
FIG. 6 is a cross sectional view showing conductive sealing members 7A each fixed in each end portion of the light-emitting vessel 16.

As shown in FIG. 6, the light-emitting vessel 16 has two end portions 19. It is thus possible to perform the above treatment for each of the end portions so that the end portions of the vessel 16 may be sealed. Consequently, a pair of the electrodes 10 are fixed at predetermined positions in the inner space 24 of the vessel 16 for arc discharge.

The procedure to seal the both end portions of the vessel is not particularly limited. For example, in FIG. 6, the upper end portion 19 may be sealed, a light-emitting substance may be then supplied from the lower end 18 into the inner space 24, and the lower end portion 19 may be sealed. Alternatively, another supply hole may be provided in the main body 17 of the vessel. In this case, after both end portions are sealed in FIG. 6, a light-emitting substance is supplied through the supply hole into the inner space 24. The supply hole of the main body 17 of the vessel is then sealed. Conductivity is not necessary for the sealing portion, so that the supply hole may be sealed with a conventional glass.

When the conductive sealing member is produced by reduction sintering process, it was proved that silica components may be volatized from the surface of the sealing member during the sintering to generate fine irregularities on the surface. It is thus possible to further improve the adhesion of quartz constituting the vessel and the surface of the sealing member and to improve the reliability of the sealing, when the end portion of the vessel is sealed by deformation with a pressure.

In a preferred embodiment, a recess is formed on the end face of the conductive sealing member. An electrode member is introduced in the recess and electrically connected with the sealing member in the recess. It is thereby possible to further improve the joining of the electrode member to the sealing member and thus to reduce the resistance in the joining portion. For example, as shown in FIG. 3(*b*), a recess 14 is provided on the outer end face 7*a* of the sealing member 7D, and a power supply member 8 is inserted into the recess 14. The power supply member 8 and sealing member 7D are joined with each other through a conductive joining agent 15. A recess 14 is formed on the inner end face 7*b* of the sealing member 7D, and the end portion of the electrode 11 is inserted into the recess 14. The end portion of the electrode 11 and sealing member 7D are joined through the conductive joining layer 15 in the recess 14.

In a preferred embodiment, a joining agent is provided at a predetermined position on the side wall surface of the conductive sealing member for positioning the sealing member in the end portion. It is thus possible to prevent the deviation of relative position of the sealing member with respect to the light-emitting vessel when the sealing member is joined with the end portion of the vessel. Consequently, the positioning of the electrode member to be fixed onto the sealing member is made secure so that the discharge arc may be stabilized.

Figure 7:
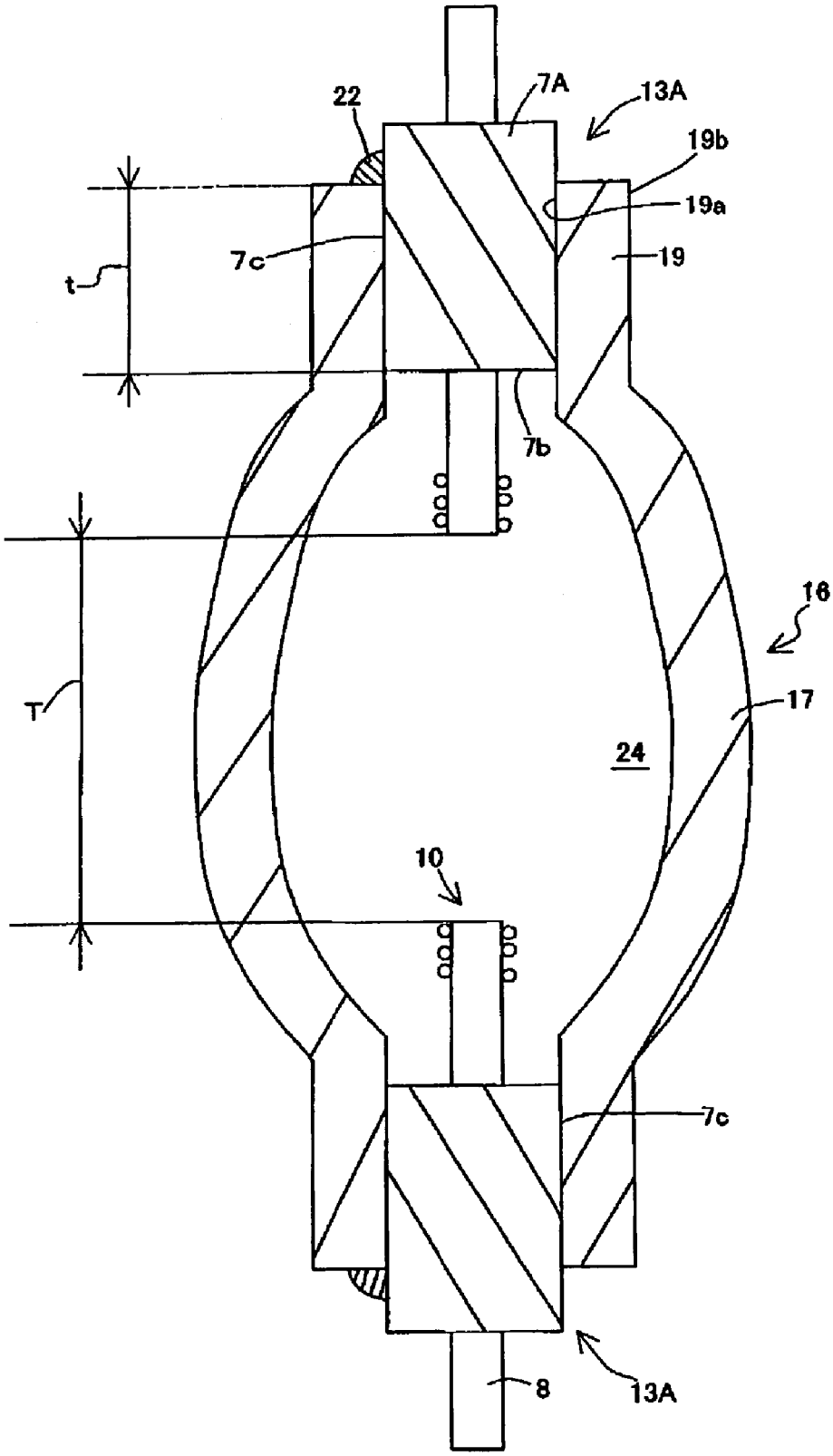
FIG. 7 is a cross sectional view showing conductive sealing members 7A each fixed in each end portion of the light-emitting vessel 16, in which a joining material 22 is adhered onto a side wall surface 7*c* of the sealing member 7A.

For example as shown in FIG. 7, the joining material 22 is adhered onto a predetermined position of the side wall surface 7*c* of the sealing member 7A. The sealing member 7A is contained in the end portion 18 and the end portion 18 is then heated and softened so that the sealing member 7A is fixed by a pressure. At this stage, the positioning of the sealing member 7A may be made by the joining material 22. The distance "t" from the joining material 22 to the end face 7*b* may be thus maintained at a specified value. Both sealing members 7A may be positioned, respectively, at both end portions of the vessel 60 that a distance "T" between the electrode members 10 may be maintained at a specific value. The material of the protrusion may be, but is not limited to, a cermet or solder.

Further, in a preferred embodiment, a positioning protrusion is provided on the inner wall surface 19*a* of the end portion 19 of the vessel 16 for positioning the conductive sealing member. It is thus possible to secure the relative position of the sealing member with respect to the vessel, when the sealing member is joined with the end portion of the vessel. Further, the longitudinal direction of the sealing member may be made substantially parallel with the central axis of the sealing member. Consequently, the position of the electrode member, to be fixed to the sealing member, with respect to the vessel is made constant so that the discharge arc may be stabilized.

Figure 8:
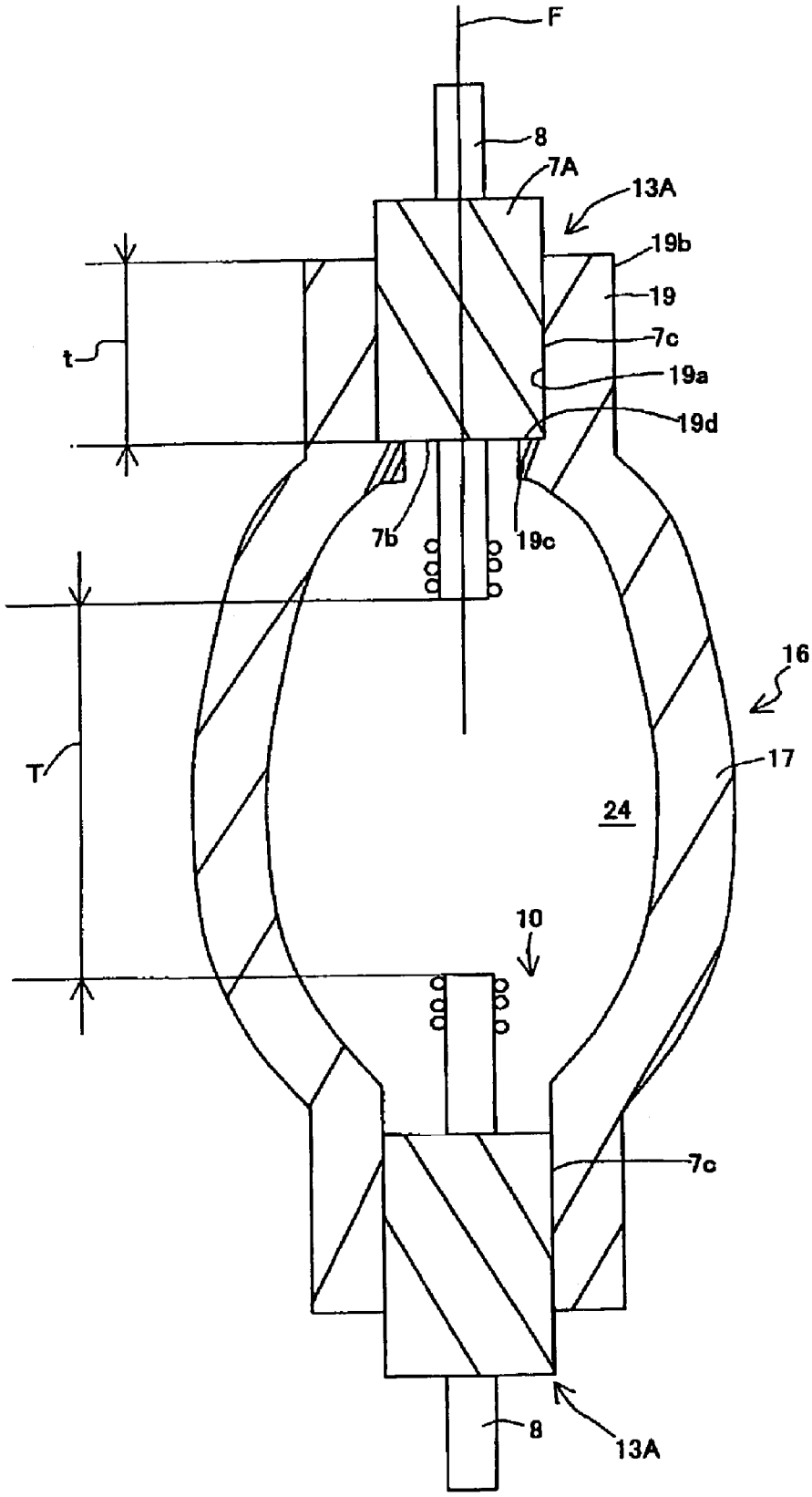
FIG. 8 is a cross sectional view showing conductive sealing members 7A fixed in the end portions of the vessel 16, respectively, in which a positioning protrusion 19*c* is provided on an inner wall surface of the end portion 19.

For example as shown in FIG. 8, a positioning protrusion 19*c* is formed on the inner wall surface 19*a* of the end portion 19 of the vessel 16 for positioning the sealing member. When the sealing member 7A is inserted into the end portion, the inner wall surface 7*b* of the sealing member 7A contacts with the positioning face 19*d* of the protrusion 19*c*. Consequently, the depth of insertion of the sealing member 7A may be made constant and the sealing member 7A may be positioned substantially parallel with the central axis "F" of the vessel.

EXAMPLES

Experiment 1

The high pressure mercury lamp shown in FIG. 6 was produced, according to the process described referring to FIGS. 1 to 6. Specifically, polyvinyl alcohol was added to silica powder to produce silica granules. Aqueous solution of nickel nitrate was added to tungsten oxide powder and uniformly mixed to produce mixture, which was then coated onto the surface of the silica granules. The thus obtained powdery raw material was press molded at a pressure of 0.5 to 3.0 ton/cm$^2$ to produce a disk-shaped body. The thus obtained shaped body was then dewaxed at a temperature of 600 to 800° C. and sintered under reducing atmosphere at a temperature of 1500 to 1700° C. to produce a cylindrical shaped conductive sealing member made of a cermet. The sealing member has a mean granule diameter of 300 μm, a tungsten content of 10 volume percent and a nickel content of 1 weight part with respect to 100 weight parts of tungsten.

Ru—Mo—B soldering agent was applied onto both end faces of the thus obtained sealing member. The soldering agent was then heated at 1600° C. for 10 minutes to solder the power supply and electrode members.

Mercury and argon were sealed in the light-emitting vessel made of quartz as shown in FIG. 6. The end portion was then heated and deformed by applying a pressure to fix the sealing member in the end portion The vessel was then heated at 2000 hours so that the inner pressure was maintained at about 150 atm. The leakage of the light-emitting substance was tested by means of Tesla coil to prove the absence of the leakage. The electrical conductivity of the sealing member was 70 mΩ.

Experiment 2

A high pressure mercury lamp was produced according to the same process as the experiment 1. However in the example 2, the cermet constituting the sealing member had a mean granule diameter of 400 μm, a tungsten content of 8 volume percent, and a nickel content of 3 weight parts with respect to 100 weight parts of tungsten. Mercury and argon were sealed in the vessel 16. The end portion was then heated and deformed to fix the sealing member in the end portion with pressure applied. The vessel was held for 2000 hours so that the inner pressure was adjusted at about 150 atm. The leakage of the light-emitting substances was tested by means of Tesla coil to prove the absence of the gas leakage. The sealing member had an electrical conductivity of 80 mΩ.

As described above, the present invention provides a high pressure mercury lamp having a light-emitting vessel made of quartz, in which the adverse effects due to a difference of thermal expansion between a conductive sealing member and the vessel may be reduced and the reliability of the lamp may be improved, even when the lamp is operated at a high pressure.

The present invention has been explained referring to the preferred embodiments. However, the present invention is not limited to the illustrated embodiments which are given by way of examples only, and may be carried out in various modes without departing from the scope of the invention.

The invention claimed is:

1. A high pressure mercury lamp comprising:

a light-emitting vessel having a main portion and an end portion, both the main portion and the end portion being made of quartz, the main portion enclosing a first space, the end portion enclosing a second space in communication with the first space, a conductive sealing plug member inserted in the second space and fixed in said end portion and electrically connected to said end portion, the conductive sealing plug member having an inner end and an outer end, the inner end of the conductive sealing plug member being exposed to the first space, an electrode member contained in said vessel and attached to the inner end of the conductive sealing plug member, and a power supply member attached to the outer end of the conductive sealing plug member, wherein said conductive sealing plug member is press sealed in said end portion, the end portion is softened and press sealed against the plug member upon heating, a side wall surface of the conductive sealing plug member is pressured into direct contact with an inner wall surface of the end portion, said conductive sealing plug member is composed of a sintered body made from silica granules each having a coating of at least one of a metal and a compound of a metal, and said sintered body comprises a conductive network structure made of said metal and having a content of said metal of not higher than 20 volume percent, wherein said conductive sealing plug member has a part substantially having a shape of a body of rotation formed by rotating a figure around the central axis of said vessel, and wherein the side wall surface of the conductive sealing plug member is pressed over the whole of the inner wall surface of the end portion radially toward the central axis of said-vessel.

2. The lamp of claim 1, wherein an inner pressure in said light-emitting vessel is not lower than 100 atm.

3. The lamp of claim 1, wherein said end portion has a positioning protrusion formed on said inner wall surface for positioning said conductive sealing plug member.

4. The lamp of claim 1, wherein the inner end of said conductive sealing plug member has an end face with a recess formed therein, and said electrode member is inserted in said recess so that said electrode member is electrically connected to said conductive sealing plug member in said recess.

5. The lamp of claim 1, wherein said sintered body is produced by reduction sintering of said silica granules having said coating of said compound.

6. The high pressure mercury lamp of claim 5, wherein said compound comprises an oxide of a first metal and a nitride of a second metal.

7. The lamp of claim 1, wherein said metal is one or more metal selected from the group consisting of tungsten, molybdenum, rhenium, nickel and the alloys thereof.

8. The lamp of claim 1, wherein said conductive sealing plug member has a protrusion formed on said side wall surface for positioning said conductive sealing plug member with respect to said end portion.

* * * * *